US008292299B1

(12) United States Patent
Chartrand

(10) Patent No.: US 8,292,299 B1
(45) Date of Patent: Oct. 23, 2012

(54) CARD GAME WITH BONUS WAGERING

(75) Inventor: Adam B. Chartrand, Mayflower, AR (US)

(73) Assignee: TCPW Holdings, LLC, Mayflower, AR (US)

( * ) Notice: Subject to any disclaimer, the term of this patent is extended or adjusted under 35 U.S.C. 154(b) by 0 days.

(21) Appl. No.: 13/158,363

(22) Filed: Jun. 10, 2011

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | |
|---|---|---|---|---|
| 5,685,774 | A | 11/1997 | Webb | |
| 6,698,759 | B2 * | 3/2004 | Webb et al. | 273/292 |
| 7,325,806 | B1 * | 2/2008 | Feola | 273/292 |
| 2008/0111308 | A1 | 5/2008 | Snow | |

* cited by examiner

*Primary Examiner* — Michael Dennis
(74) *Attorney, Agent, or Firm* — Robert E. Fahr, Jr.

(57) ABSTRACT

A method of playing a card game with bonus wagering comprising the steps of establishing a card hand ranking for each combination of cards, assigning bonus wagering payouts for one or more hands, players placing bets on game play against a dealer and on being dealt a specific hand or hands, dealing cards and evaluating hands to determine losing, tying, and winning players for each wagering aspect of the game, and payout of winnings to each winning player.

18 Claims, 8 Drawing Sheets

CARD GAME WITH BONUS WAGERING

The present application relates to U.S. Pat. Nos. 5,685,774, 6,698,759, and 7,325,806, and U.S. Patent Application No. 2008/0111308, which are fully incorporated herein by reference.

BACKGROUND

The continually growing world-wide popularity of gambling, in casinos, electronically via computer games and through the Internet, makes it necessary to discover new and interesting methods of gaming and wagering to attract players. Exposure to card games in particular has become almost common place through the mainstream media, such as televised poker games on a popular sports network. Players demand card games that are novel, more challenging, and offer more opportunities to win. Casinos and other gaming businesses desire to attract players but must also ensure that they can stay in business by making more money than they pay out to players. What is needed to satisfy the needs of both players and gaming businesses is a combination of new games with multiple options of wagering on the games. Information relevant to attempts to address these problems can be found in U.S. Pat. Nos. 5,685,774, 6,698,759, and 7,325,806, and U.S. Patent Application No. 2008/0111308. Despite these efforts, there remains an increasing demand for something new and better, there is a need for a novel card game with bonus wagering.

SUMMARY

The present invention is directed to a method that satisfies the need for a novel method of playing cards that is fast-paced, challenging and provides opportunities for players to wager and gambling businesses to make a profit. The method comprises playing a game with a standard deck of fifty-two playing cards where a banker collects wagers and pays out winnings, a dealer deals cards, and one or more players wager and play against the dealer and each other. Each player has the opportunity to play against the dealer, and for the bonus aspects of the game, each player may play against other players, or against the odds of having one of a set of predetermined hands. In various embodiments of the invention, the dealer may also be the banker.

The present invention combines a game of cards with a game of war. The card game aspect of the invention relates to hands dealt to players and the ranking of hands based on the combination of cards in the hand. The war aspect of the game incorporates the one-on-one game between a player and a dealer. Traditional war with cards is played among two or more players where the player with the highest ranked single card wins. Embodiments of the present invention incorporate hands of three or five cards with a war aspect to create a new game.

In an embodiment, a method of playing a card game with bonus wagering comprises the steps of: a banker, establishing a three-card hand ranking by assigning a rank to each unique combination of three cards from a standard deck of fifty-two playing cards; the banker, assigning a poker bonus pay-out ratio to one or more of the unique three-card combinations in the three-card hand ranking; each of one or more players, placing a war bet and a poker bonus bet with the banker to play in a base round; a dealer, dealing a base hand of three cards face up to each player and to the dealer; the dealer, evaluating the rank of each player's base hand and the dealer's base hand based on the three-card hand ranking; selecting the base round players whose base hand ranks lower than the dealer's base hand as losing base round players; selecting the base round players whose base hand ranks the same as the dealer's base hand as tying base round players; selecting the base round players whose base hand ranks higher than the dealer's base hand as winning base round players; selecting the base round players whose base hand matches a hand to which a poker bonus pay-out ratio has been assigned as winning poker bonus players; each losing base round player, forfeiting that player's war bet to the banker; the banker, paying each winning poker bonus player the amount of that player's poker bonus bet times the poker bonus pay-out ratio corresponding to that player's base hand; and, the banker, paying each winning base round player an amount that is greater than that player's war bet but less than ten times that player's war bet.

In an embodiment of the invention a bonus aspect of game play called Bonus War includes the additional steps of: a the banker, establishing a five-card hand ranking by assigning a rank to each unique combination of five cards from a standard deck of fifty-two playing cards; each of one or more of the tying base round players, each making placing a bonus war bet to with the banker equal to that player's war bet to play in a bonus round; the banker, paying each of the tying base round players not playing in the bonus round an amount equal to no more than that player's war bet; the dealer, dealing two bonus cards face up to each player playing in the bonus round and to the dealer; each bonus round player, combining that player's bonus cards with that player's base hand to form a player's bonus hand; the dealer, combining the dealer's bonus cards with the dealer's base hand to form a dealer's bonus hand; the dealer, evaluating the rank of each player's bonus hand and the dealer's bonus hand based on the bonus five-card hand ranking; selecting the bonus round players whose bonus hand ranks lower than the dealer's bonus hand as losing bonus round players; selecting the bonus round players whose bonus hand ranks the same as the dealer's bonus hand as tying bonus round players; selecting the bonus round players whose bonus hand ranks higher than the dealer's bonus hand as winning bonus round players; each losing bonus round player, forfeiting that player's war bet and bonus war bet to the banker; and, the banker, paying each winning bonus round player an amount that is at least ten times but less than one-hundred times that player's bonus war bet.

An embodiment of the invention allows tying Bonus War players to play an additional Super Bonus War round and includes the additional steps of: each of one or more of the tying bonus round players, making a super bonus war bet to with the banker equal to that player's war bet to play in a super bonus round; the banker, paying each tying bonus round player not playing in the super bonus round an amount that is no more than five times that player's bonus war bet; the dealer, dealing one super bonus card face up to each player playing in the super bonus round and to the dealer; each super bonus round player, selecting five cards from the combination of that player's bonus hand and super bonus card to form that player's super bonus hand; the dealer, selecting five cards from the combination of the dealer's bonus hand and super bonus card to form the dealer's super bonus hand; the dealer, evaluating the rank of each player's super bonus hand and the dealer's super bonus hand based on the bonus five-card hand ranking; selecting the super bonus round players whose super bonus hand ranks lower than the dealer's super bonus hand as losing super bonus round players; selecting the super bonus round players whose super bonus hand ranks the same as the dealer's super bonus hand as tying super bonus round players; selecting the super bonus round players whose super bonus hand ranks higher than the dealer's super bonus hand as winning super bonus round players; each losing super bonus round player, forfeiting that player's war bet, bonus war bet and super bonus war bet to the banker; and, the banker, paying each winning super bonus round player an amount that is at least one-hundred times but no more than one-thousand times that player's super bonus war bet.

An embodiment of the invention adds a wagering bonus to the base round of the game. In addition to playing against the dealer, two or more of the players may choose to play against each other, this is referred to as the community bonus and includes the following additional steps: prior to the dealing of the base hand, each of two or more of the players, each making placing a community war bet to with the banker prior to the dealing of the base hand to play community war; selecting the community war player whose base hand ranks highest among the base hands of all community war players as the a winning community war player; and, the banker, paying the winning community war player all from the accumulated community war bets.

BRIEF DESCRIPTION OF THE DRAWINGS

These and other features, aspects, and advantages of the present invention will become better understood with regard to the following description, appended claims, and accompanying drawings where:

DESCRIPTION OF PREFERRED EMBODIMENTS

Figure 1:
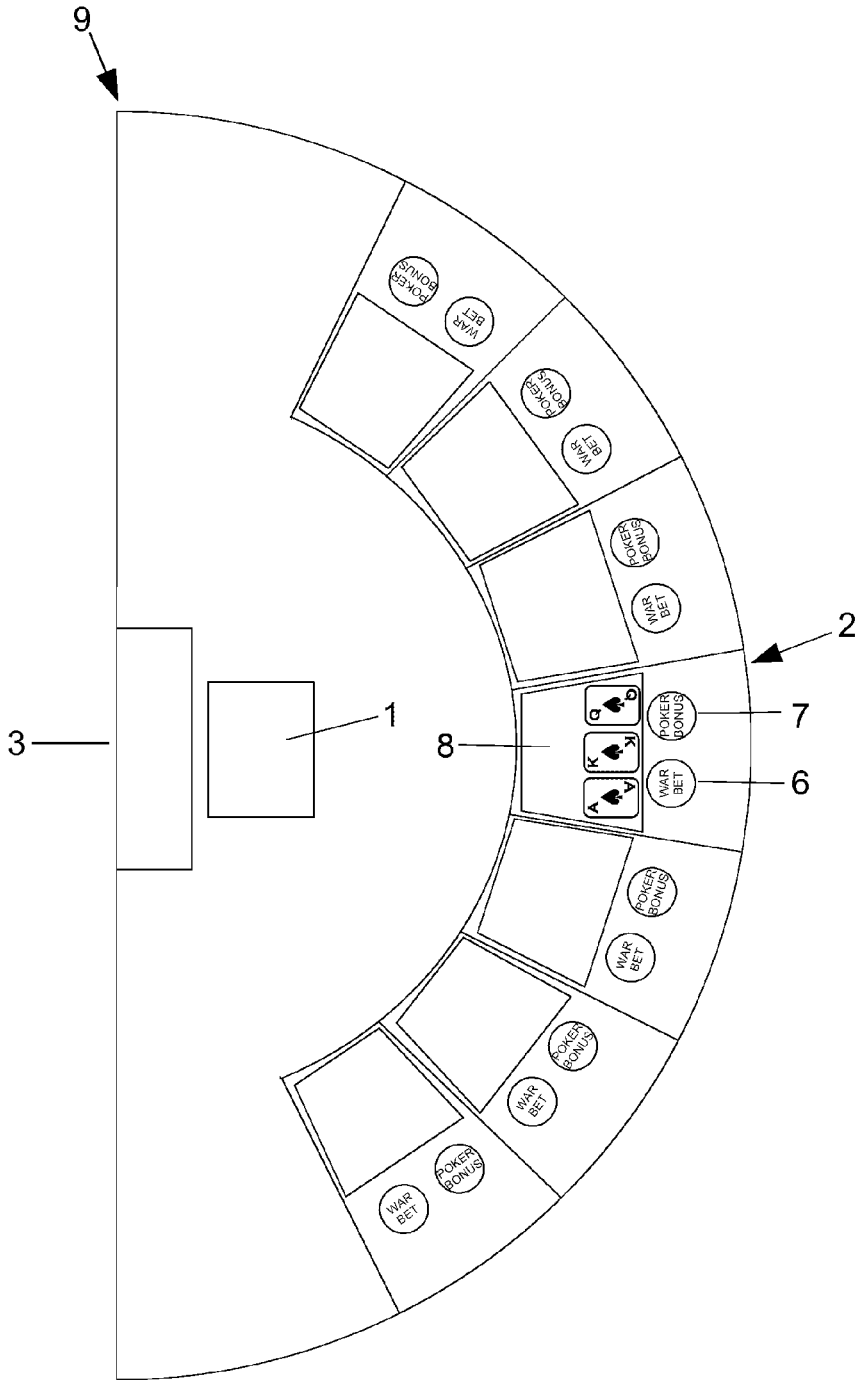
FIG. 1 shows a layout of a gaming table upon which an embodiment of the invention may be played.

Various embodiments of the invention are directed to card games played using a standard fifty-two card deck of playing cards where the games may be played with physical cards on a game table or board, or using electronic images of cards on a computer, electronic machine, hand-held device, or a mechanical device such as a slot machine. The various embodiments of the invention involve one or more rounds of game play including a base round, a bonus round, and a super bonus round. Players advance through the rounds by tying with the dealer and placing additional bets on the outcome of game play. During the rounds of game play, various embodiments of the invention provide opportunities for bonus wagering by players.

Typical casino card games are played with one or more standard playing card decks with each deck consisting of fifty-two cards. The fifty-two cards consist of four suits, with each suit having thirteen cards. The four suits are "Hearts", "Diamonds", "Clubs", and "Spades." The thirteen cards in each suit consist of the numbered cards "2" through "10", and the lettered cards "J", "Q", In typical casino card games players wager money or chips and play the games against a dealer and/or other players. A banker receives bets from the players, for example before cards are dealt, and holds the bets during game play, and then pays money or chips to the winning players. A dealer is responsible for informing players regarding when they must wager, dealing the cards in the proper order and proper manner to each player and the dealer, and evaluating the outcome of the game. The roles of dealer and banker are sometimes the responsibility of the dealer.

In various embodiments of the invention bonus wagering options are included to make the game more interesting to players. For example a community bonus wagering option might be included to allow players to compete against each other in addition to competing against the dealer. Bonus wagering options also include allowing players to play subsequent rounds in a game when certain conditions occur. For example, players who tie with the dealer may have the option to make a bonus bet to play in a bonus round, and players tying in a bonus round may have the option of making a super bonus bet to play in a super bonus round.

An embodiment of the invention includes a banker, a dealer, and one or more players. In some embodiments of the invention, the dealer may also be the banker and in some embodiments of the invention which include a community bonus, two or more players are necessary in order to play the game. In embodiments of the invention where the game is played on a personal computing device, hand held electronic device, or mechanical device, the decisions and actions of the dealer and the banker are incorporated into the mechanisms, electronics or software of the device.

Determination of the losing players, tying players and winning players in many card games depends upon how the cards and hands are ranked in the game. In some card games, individual cards are ranked in the following order, from lowest to highest rank value:

"2", "3", "4", "5", "6", "7", "8", "9", "10", "J", "Q", "K", "A."

In a game such as the game of War where each player has a single card hand, the player having the card with the highest rank is the winning player.

In card games where each player has a hand consisting of multiple cards instead of a single card, a hand ranking is used to determine the losing, tying, and winning players. There are various methods of ranking a hand of multiple cards. The determination of which method to use is based on the game being played or selected by the banker where multiple methods may be used in the same game. In card games where a hand consists of multiple cards, hand rankings are often based on the odds of getting a particular hand. For instance in five-card poker the following card combinations are ranked from highest to lowest:

| | |
|---|---|
| Royal Flush | "10", "J", "Q", "K", "A" all in the same suit |
| Straight Flush | Five cards in sequence, all in same suit where none of the cards is an "A" |
| Four of a Kind | Four cards of the same rank, e.g. four "2" cards |
| Full House | Three cards of the same rank plus a two cards of the same rank, e.g. "22233" |
| Flush | Five cards of the same suit but not in sequence |
| Straight | Five cards in sequence but not all in the same suit |
| Three of a Kind | Three cards of the same rank, e.g. three "2" cards |

-continued

| | |
|---|---|
| Two Pair | Two sets of card, each including two cards of the same rank, e.g. "2233" |
| One Pair | Two cards of the same rank, e.g. "22" |
| High Card | If nothing else, highest ranking card wins, "A" is the highest rank |

Poker hands of three cards can be ranked as specified in U.S. Pat. No. 5,685,774 from highest rank to lowest rank as follows:

| | |
|---|---|
| Straight Flush | Three cards in sequence all in the same suit, "AKQ" is the highest and "32A" is the lowest |
| Three of a Kind | Three cards of the same rank, "AAA" is the highest and "222" the lowest |
| Straight | Three cards in sequence but not all in the same suit, "AKQ" is the highest and "32A" the lowest |
| Flush | Three cards in one suit, "AKJ" is the highest, "AK10" is next highest and "532" is the lowest |
| Pair | Two cards of the same rank, "AAK" is the highest and "223" the lowest |
| High Card | If nothing else, highest ranking card wins, "AKJ" is the highest, "AK10" is next highest and "532" the lowest |

In embodiments of the present invention, in order to generate greater player interest in games, the banker may choose other rankings for hands. Examples include the use of card ranks and suits in unique ways that increase a player's odds of winning, such as specifying that any player's hand with an "A" beats any dealer hand, or player hands with more red cards (more cards in the suit of Diamonds or Hearts) beats a dealer's hand with less red cards. A banker may choose whether or not to use a particular ranking method based on the tradeoff between player interest and a dealer's odds of winning.

An embodiment of this invention requires the banker to determine a ranking for base hands of three cards, and for bonus and super bonus hands of five cards. Another embodiment includes the use of five-card poker rankings for bonus hand rankings, and three-card poker rankings for base hand rankings. Other embodiments of this invention may vary the base hand rankings and bonus hand rankings and use any ranking method that improves player interest in the game while still allowing the dealer to win enough times so the banker can take in more money than is paid out to players.

Figure 2:
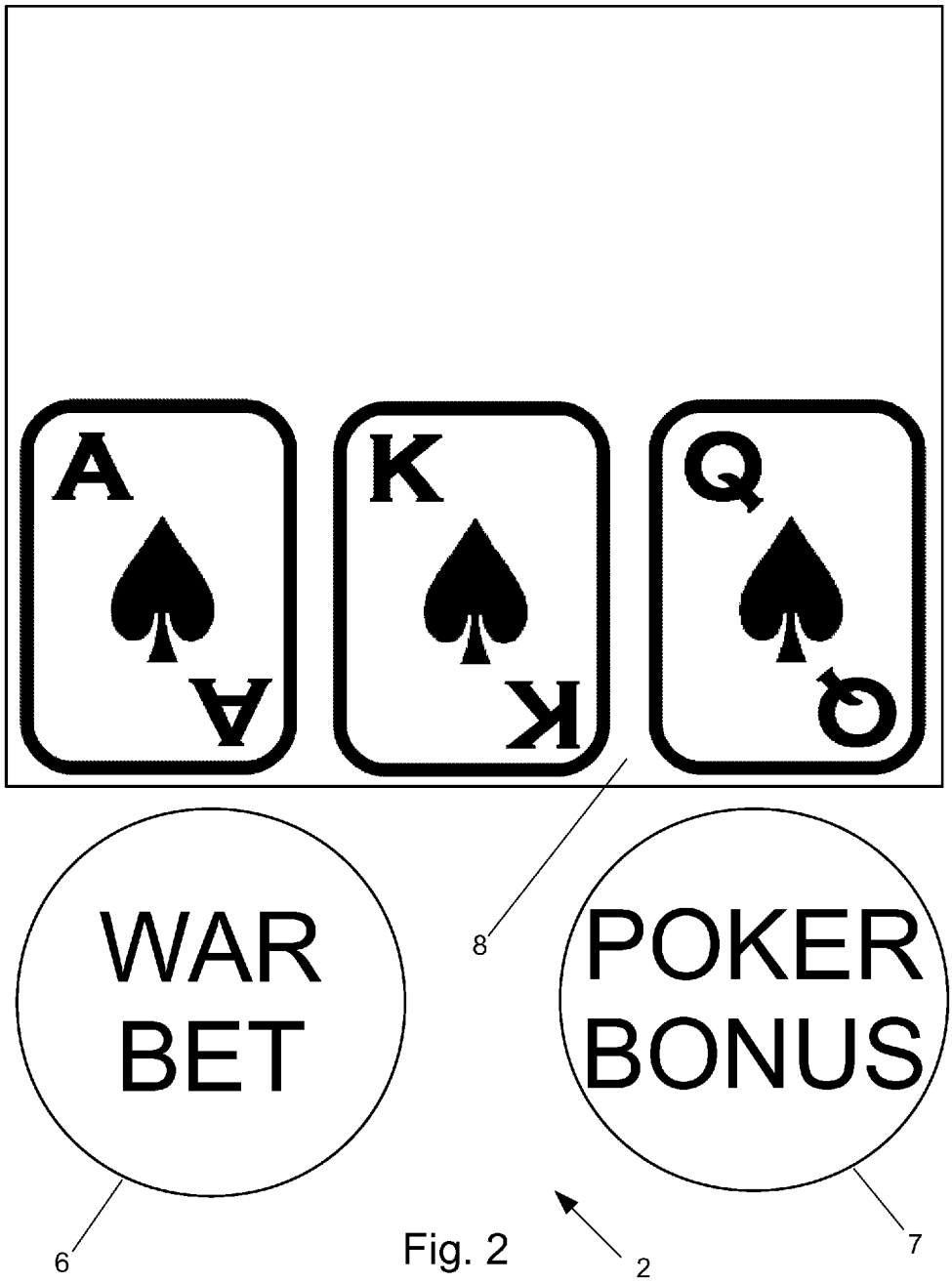
FIG. 2 shows a layout of a player area on a gaming table for an embodiment of the invention including poker bonus wagering.

In an embodiment of the invention, the base round is the first round of the game played. In order to play, a player must first make a war bet. As shown in FIG. 1 an embodiment of the invention can be played on a table surface 9 where each player has a player position 2. FIG. 1 shows a table with positions for up to seven players and one dealer. FIGS. 1 and 2 show a player position for an embodiment of the invention including a war wager area 6, and a player card area 8. In this embodiment the player places the war bet in the war wager area. The amount of the war bet may be left up to each individual player, or may be subject to lower and upper limits by the banker.

FIG. 1 also shows an embodiment of the invention with a dealer card area 1 where the dealer's hand is dealt. The chip holder area 3 is utilized by the banker, or by the dealer when acting as banker, to store losing players' chips and to retrieve chips to pay the winning players.

The base hand consists of three cards dealt to each player. In the preferred embodiment the cards are dealt three cards to a player starting with the player at the left of the dealer and moving to the dealer's right. The dealer deals the dealer's cards last. Cards may be dealt face up or face down, but in the preferred embodiment the cards are dealt face up. This helps to prevent any issues with player cheating since there is no need for the players to touch their cards.

Evaluation of the players' and dealer's hands is based on the hand rankings. In various embodiments the hand rankings are chosen by the banker. In a preferred embodiment the base hand rankings are based on three-card poker hand rankings. Once a hand ranking is chosen it is preferable to use that particular hand ranking for some time since casinos typically post the hand rankings on the table. Other embodiments of the invention such as computer, electronic, or mechanical game systems allow for more frequent changing of the hand ranking.

Selection of winners and losers is based on the hand rankings and a comparison of each player's base hand against the dealer's base hand. In a preferred embodiment base round losers are selected as those player's with a base hand that is ranked lower than the dealer's base hand. Base round winners are selected as those players whose base hand is ranked higher than the dealer's base hand. Losers forfeit their entire war bet to the banker. Winners are paid by the banker an amount that is larger than their war bet, for example two times their war bet.

Tying players are those whose base hands are ranked the same as the dealer's base hand. In a preferred embodiment tying players may quit play and receive one-half of their war bet back from the banker. Alternatively, tying players have the opportunity to continue play and possibly win more than the amount they have bet. In various embodiments if a tying player is willing to place a bonus war bet in an amount equal to their original war bet they may participate in the bonus round.

In a preferred embodiment players in the bonus round are dealt two additional cards face up by the dealer. The players combine these two bonus cards with their original three cards to form a five-card bonus hand. The banker selects the rankings by which the bonus hands are ranked. Preferably the ranking used is that for a five-card poker hand.

Selection of bonus round winners and losers is through the same process as in the base round except that the bonus hand rankings are used. In a preferred embodiment bonus round losers are selected as those players with a bonus hand that is ranked lower than the dealer's bonus hand. Bonus round winners are selected as those players whose bonus hand is ranked higher than the dealer's bonus hand. Losers forfeit all of their bets, both war and bonus war, to the banker. In a preferred embodiment winners receive a larger payout than in the base round as a reward for risking participation. In some embodiments winners are paid ten times the sum of their war bet and bonus war bet by the banker.

Tying players are those whose bonus hands are ranked the same as the dealer's bonus hand. In a preferred embodiment tying players may quit play and receiving five times the sum of their war bet and bonus war bet from the banker. Alternatively tying players have the opportunity to continue play in a super bonus round. If a tying player is willing to place a super bonus war bet in an amount that is equal to their original war bet they may participate in the super bonus round. This means that the total bet for a player entering the super bonus war round is three times the original war bet.

In a preferred embodiment players in the super bonus round are dealt one additional card face up by the dealer. The dealer also deals an additional card to the dealer. The players and dealer each now have six cards. Any five of these six cards is chosen to form their super bonus hand of their five best cards. The bonus ranking used in the previous round is used again in this round to rank the super bonus hands.

Selection of super bonus round winners and losers is through the same process as in the bonus round. In a preferred embodiment super bonus round losers are selected as those players with a super bonus hand that is ranked lower than the dealer's super bonus hand. Super bonus round winners are selected as those players whose super bonus hand is ranked higher than the dealer's super bonus hand. Losers forfeit all of their bets, including their war, bonus war and super bonus war bets, to the banker. In a preferred embodiment winners receive a larger payout than in the bonus round as a reward for risking participation. In some embodiments winners are paid one-hundred times the sum of their war bet, bonus war bet and super bonus war bet by the banker.

In a preferred embodiment the super bonus round is the final round. Tying players whose super bonus hand ranks the same as the dealer's super bonus hand are paid an amount one-hundred times the sum of their war bet, bonus war bet, and super bonus war bet by the banker. At this point the game ends.

FIGS. 1, 2, 3 and 4 also show an embodiment of the invention which provides the opportunity for the player to make a poker bonus bet. The poker bonus bet is bet by the player in the poker bonus wager area 7. The player is wagering that the player's base hand will match one of a predetermined set of hands, and the player will receive a payout from the banker based on which hand was matched. In a preferred embodiment, the poker bonus hands are based on three-card poker hands and the poker bonus payout ratios are as follows:

| | |
|---|---|
| Straight Flush | 40 to 1 |
| Three of a Kind | 30 to 1 |
| Straight | 6 to 1 |
| Flush | 4 to 1 |
| Pair | 1 to 1 |

Once the base hand has been dealt, the dealer evaluates the players' hands and if any player's hand matches one of the poker bonus hands, the banker pays that player an amount equal to that player's poker bonus bet times the poker bonus payout ratio. For instance if the banker has chosen to use the three-card poker hand of a preferred embodiment, a player having a base hand that is "three of a kind", and wagering ten dollars will receive a payout of thirty times ten dollars or three-hundred dollars as a poker bonus payout from the banker. In a preferred embodiment players winning the poker bonus aspect of the game will receive their winnings regardless of whether they win, lose or tie on their war bet in the base round. This method of bonus wagering provides an additional chance for players to come out ahead on their winnings and attracts players to the game.

Figure 3:
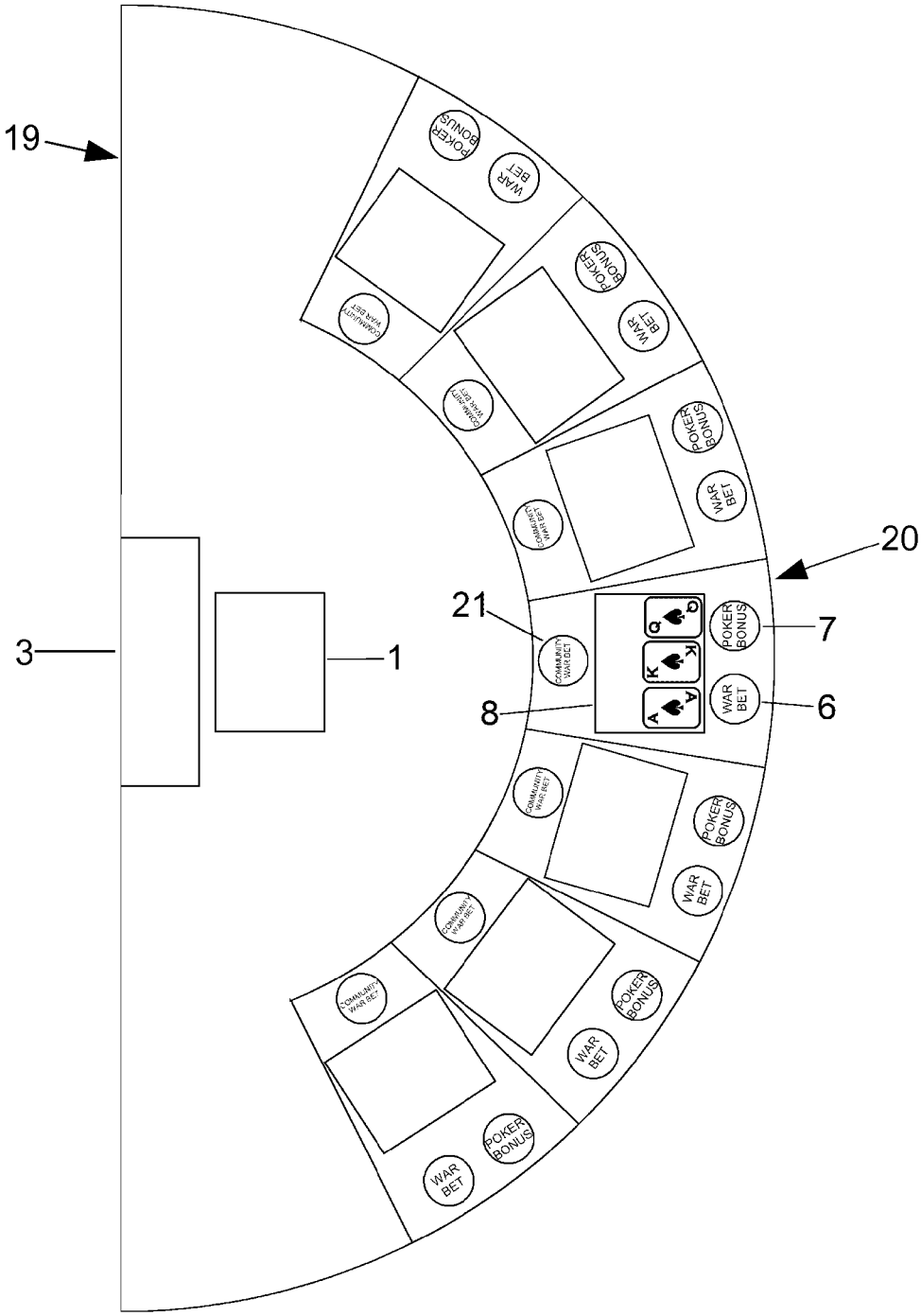
FIG. 3 shows a layout of a gaming table upon which an embodiment of the invention may be played including community bonus wagering.
Figure 4:
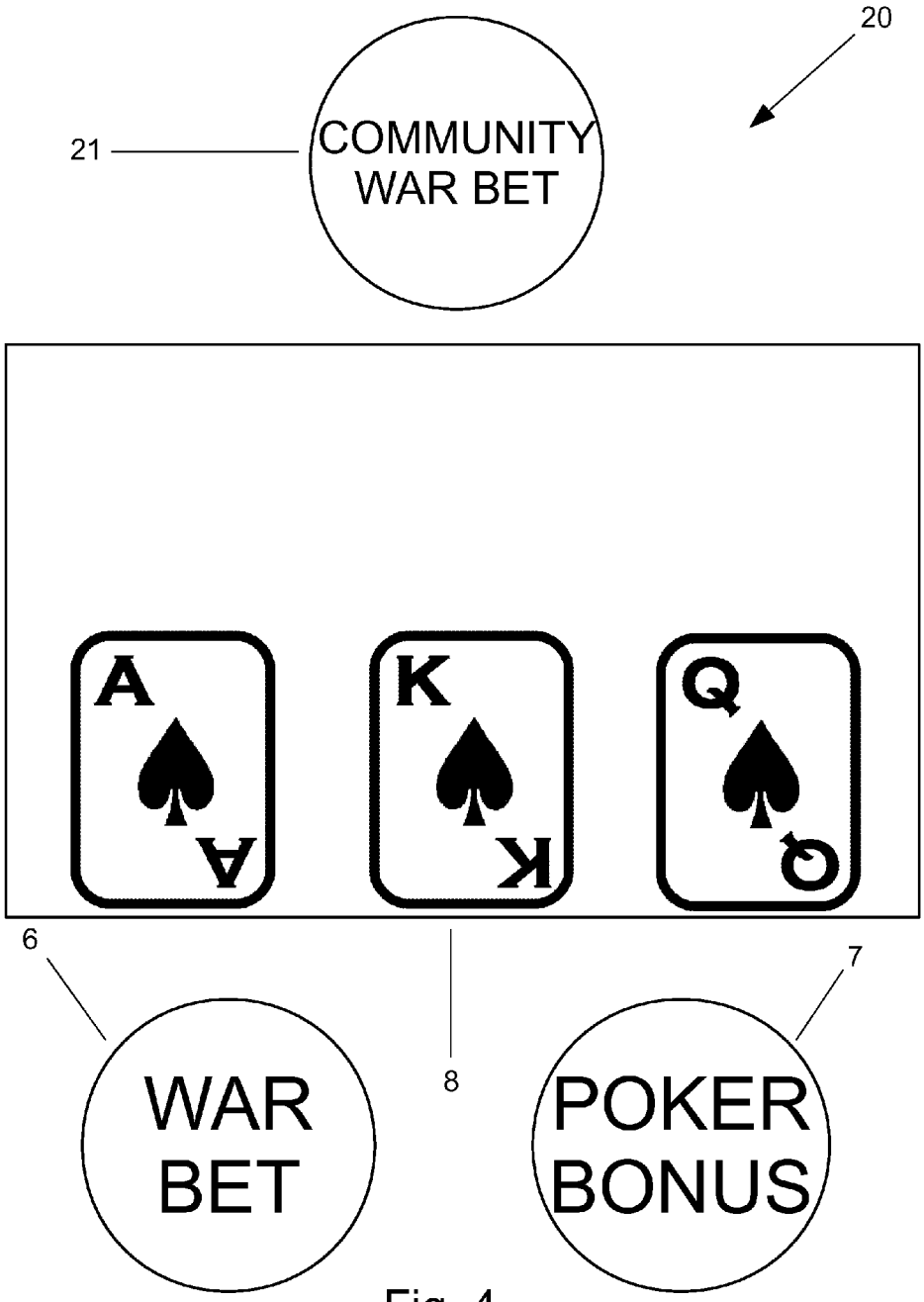
FIG. 4 shows a layout of a player area on a gaming table for an embodiment of the invention including community bonus wagering.

FIGS. 3 and 4 show another embodiment of the invention incorporating a community war bet wagering bonus. In this embodiment, players have the opportunity to place a community war bet by placing a bet in the community wager area 21. Each player placing a community war bet in the base round is playing against all other community war players. When the base hands are evaluated, the community war bet winner is the player whose hand ranks higher than the other players playing community war. In various embodiments the community bet war winner receives the full amount of all community war bets made during that base round.

Figure 5:
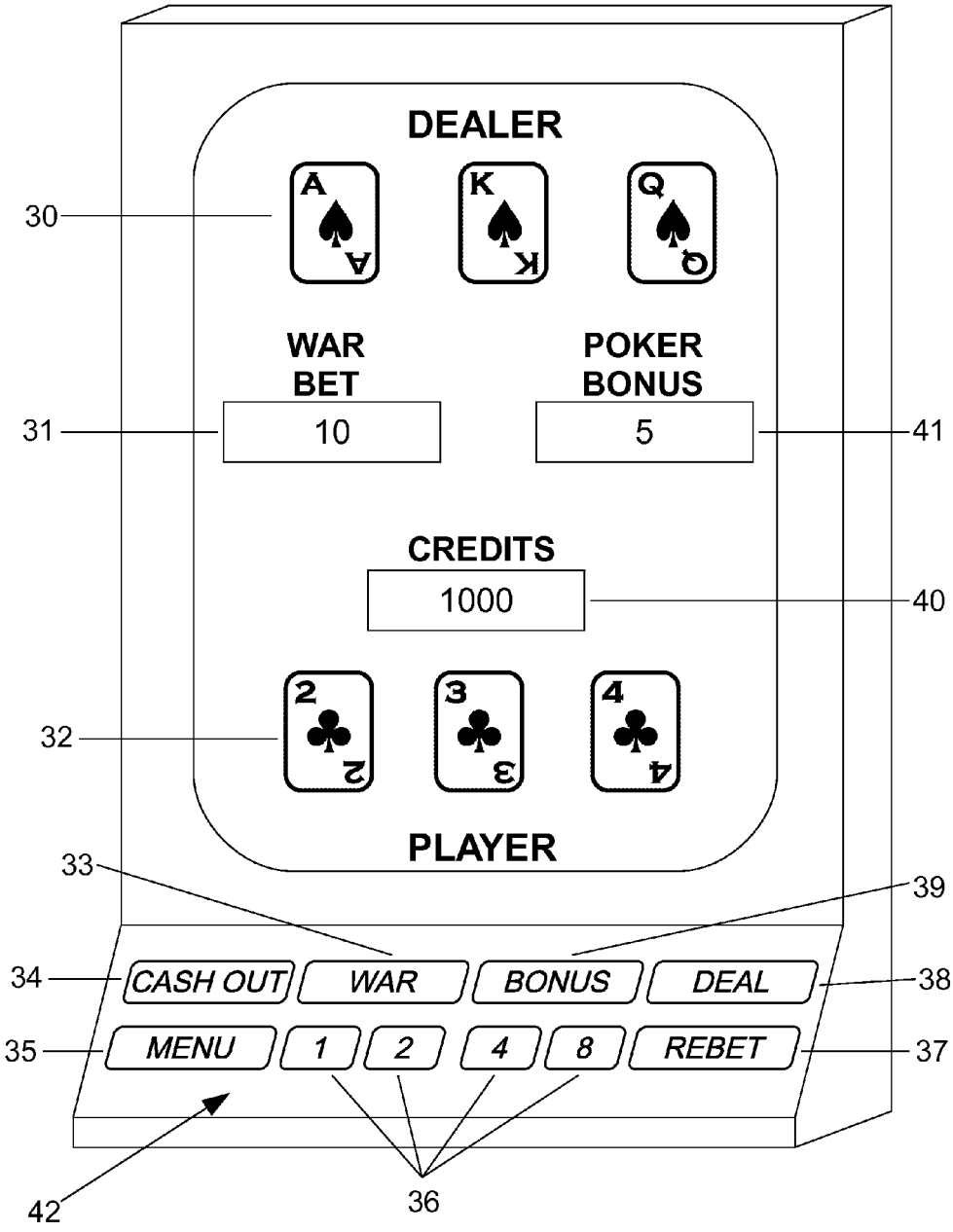
FIG. 5 shows an embodiment of the invention for an electronic game.

FIG. 5 shows an embodiment of the invention implemented as a computer or electronic gaming machine. The game is played in a manner similar to the table top embodiment. The player interacts with the machine by pressing buttons 42 on the front panel of the machine. The player initially places a war bet by selecting the war bet button 33 and then entering the amount of the war bet 31 by selecting the desired number of tokens buttons 36. The player may make the optional poker bonus bet by selecting the bonus button 39 and then entering the amount of the poker bonus bet 41 by selecting the desired number of tokens buttons 36. When the player is finished making bets, the player selects the deal button 38 to deal the player's cards 32 and dealer's cards 30. The machine displays the cards and then applies the winning or losing to the player's credits 40. The player may play again by selecting the rebet button 37, or quit by selecting the cash out button 34. The player may select the menu button 35 to get help and instructions on the game and to see information about the creators of the game.

Figure 6:
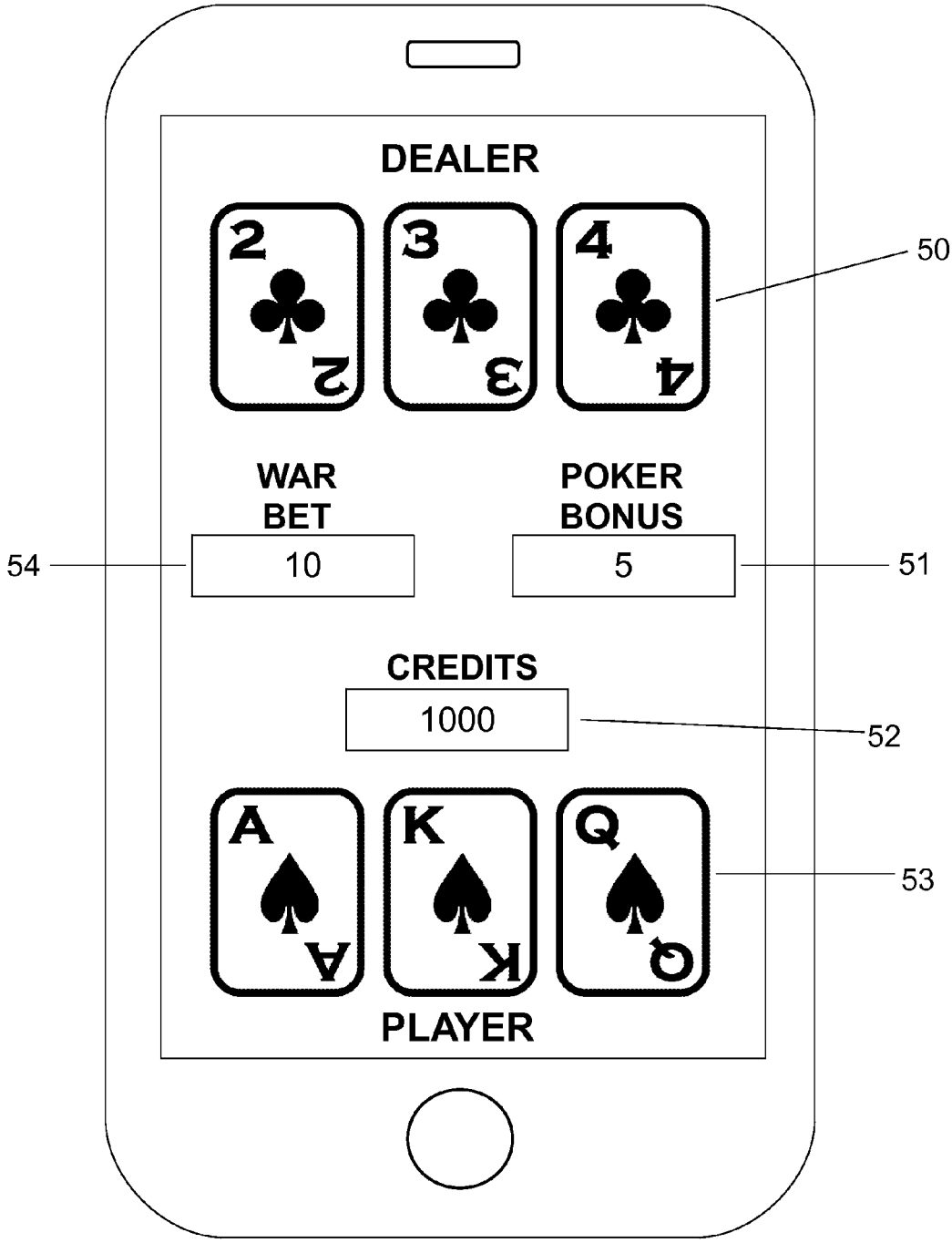
FIG. 6 shows an embodiment of the invention for a hand-held electronic device.

FIG. 6 shows an embodiment of the invention implemented as a hand-held game device or smart phone.

One or more of the embodiments have one or more of the advantages, including providing ways for casinos to attract more players and generate more income, making the experience more entertaining and enjoyable for players by providing multiple bonus methods for wagering. One or more of the embodiments is also appealing to a broad range of player types such as table players, computer players, electronic device players and other machine players. Not all of the advantages of the present invention are being listed. The present invention does not require that all the advantageous features and all the advantages need to be incorporated into every embodiment of the invention.

Figure 7:
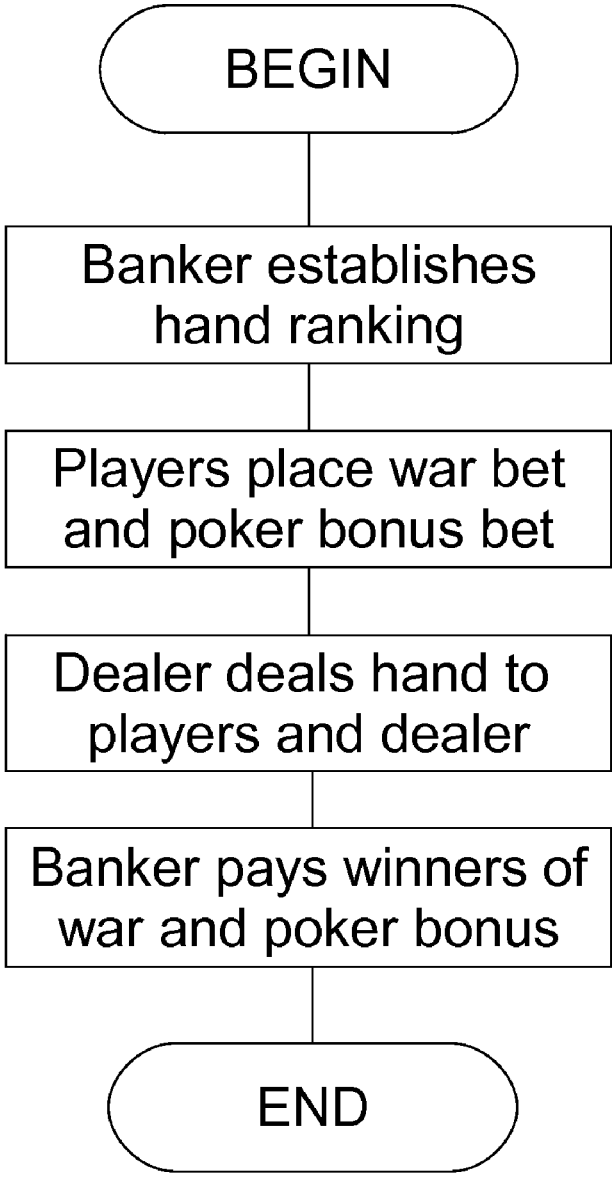
FIG. 7 shows a flowchart describing an embodiment of the invention.
Figure 8:
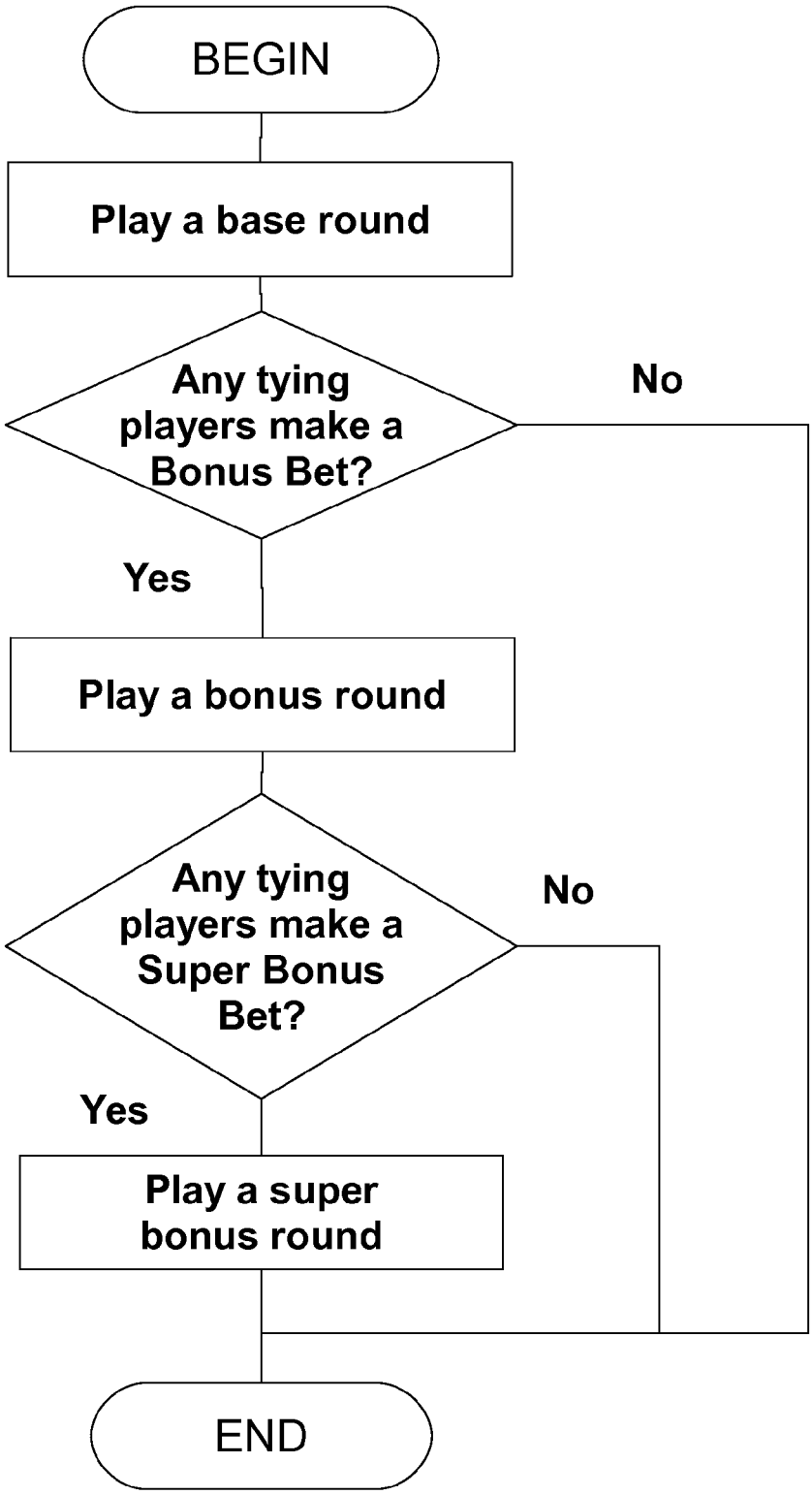
FIG. 8 shows a flowchart describing an embodiment of the invention including bonus and super bonus rounds.

FIGS. 7 and 8 show flowcharts describing a summary of game play for various embodiments of the present invention. FIG. 7 describes a summary of the base round game flow. FIG. 8 describes a summary of the game flow for an embodiment including the base, bonus and super bonus rounds.

What is claimed is:

1. A method of playing a card game with bonus wagering comprising the steps of: causing an electronic machine to execute a plurality of instructions to operate with an input device and display device to provide said card game with bonus wagering, said card with bonus wagering comprising the steps of: a. a banker, establishing a three-card hand ranking by assigning a rank to each unique combination of three cards from a standard deck of fifty-two playing cards; b. the banker, assigning a poker bonus pay-out ratio to one or more of the unique three-card combinations in the three-card hand ranking; c. each of one or more players, placing a war bet and a poker bonus bet with the banker to play in a base round; d. a dealer, dealing a base hand of three cards face up to each player and to the dealer; e. the dealer, evaluating the rank of each player's base hand and the dealer's base hand based on the three-card hand ranking; f. selecting the base round players whose base hand ranks lower than the dealer's base hand as losing base round players; g. selecting the base round players whose base hand ranks the same as the dealer's base hand as tying base round players; h. selecting the base round players whose base hand ranks higher than the dealer's base hand as winning base round players; selecting the base round players whose base hand matches a hand to which a poker bonus pay-out ratio has been assigned as winning poker bonus players; each losing base round player, forfeiting that player's war bet to the banker; k. the banker, paying each winning poker bonus player the amount of that player's poker bonus bet times the poker bonus pay-out ratio corresponding to that player's base hand; and, l. the banker, paying each winning base round player an amount that is greater than that player's war bet but less than ten times that player's war bet; further including the steps of: m. the banker, establishing a five-card hand ranking by assigning a rank to each unique combination of five cards from a standard deck of fifty-two playing cards; n. each of one or more of the tying base round players, placing a bonus war bet with the banker equal to that player's war bet to play in a bonus round; o. the banker, paying each of the tying base round players not playing in the bonus round an amount equal to no more than that player's war bet; p. the dealer, dealing two bonus cards face up to each player playing in the bonus round and to the dealer; q. each bonus round player, combining that player's bonus cards with that player's base hand to form a player's bonus hand; r. the dealer, combining the dealer's bonus cards with the dealer's base hand to form a dealer's bonus hand; s. the dealer, evaluating the rank of each player's bonus hand and the dealer's bonus hand based on the five-card hand ranking; t. selecting the bonus round players whose bonus hand ranks lower than the dealer's bonus hand as losing bonus round players; u. selecting the bonus round players whose bonus hand ranks the same as the dealer's bonus hand as tying bonus round players; v. selecting the bonus round players whose bonus hand ranks higher than the dealer's bonus hand as winning bonus round players; w. each losing bonus round player, forfeiting that player's war bet and bonus war bet to the banker; and, x. the banker, paying each winning bonus round player an amount that is at least ten times but less than one-hundred times that player's bonus war bet.

2. The method of claim 1 further including the step of the banker, paying each tying base round player an amount that is no more than that player's war bet.

3. The method of claim 1 where the three-card hand ranking is like three-card poker hand ranking.

4. The method of claim 1 further including the steps of:

a. each of two or more of the players, placing a community war bet with the banker prior to the dealing of the base hand to play community war;

b. selecting the community war player whose base hand ranks highest among the base hands of all community war players as a winning community war player; and, c. the banker, paying the winning community war player from the accumulated community war bets.

5. The method of claim 4 where the banker, paying the winning community war player all of the accumulated community war bets.

6. The method of claim 1 further including the step of the banker, paying each tying bonus round player an amount that is no more than five times that player's bonus war bet.

7. The method of claim 1 where the five-card hand ranking is like five-card poker hand ranking.

8. The method of claim 1 further including the steps of: a. each of one or more of the tying bonus round players, making a super bonus war bet with the banker equal to that player's war bet to play in a super bonus round; b. the banker, paying each tying bonus round player not playing in the super bonus round an amount that is no more than five times that player's bonus war bet; c. the dealer, dealing one super bonus card face up to each player playing in the super bonus round and to the dealer; d. each super bonus round player, selecting five cards from the combination of that player's bonus hand and super bonus card to form that player's super bonus hand; e. the dealer, selecting five cards from the combination of the dealer's bonus hand and super bonus card to form the dealer's super bonus hand; f. the dealer, evaluating the rank of each player's super bonus hand and the dealer's super bonus hand based on the five-card hand ranking; g. selecting the super bonus round players whose super bonus hand ranks lower than the dealer's super bonus hand as losing super bonus round players; h. selecting the super bonus round players whose super bonus hand ranks the same as the dealer's super bonus hand as tying super bonus round players; selecting the super bonus round players whose super bonus hand ranks higher than the dealer's super bonus hand as winning super bonus round players; each losing super bonus round player, forfeiting that player's war bet, bonus war bet and super bonus war bet to the banker; and, k. the banker, paying each winning super bonus round player an amount that is at least one-hundred times but no more than one-thousand times that player's super bonus war bet.

9. The method of claim 8 further including the step of the banker, paying each tying super bound round player an amount that is at least ten-thousand times but no more than twenty-thousand times that player's super bonus war bet.

10. A method of playing a card game with bonus wagering, comprising the steps of: causing an electronic machine to execute a plurality of instructions to operate with an input device and display device to provide said card game with bonus wagering, said card with bonus wagering comprising the steps of: a. a banker, establishing a three-card hand ranking by assigning a rank to each unique combination of three cards from a standard deck of fifty-two playing cards; b. the banker, assigning a poker bonus pay-out ratio to one or more of the unique three-card combinations in the three-card hand ranking; c. the banker, establishing a fve-card hand ranking by assigning a rank to each unique combination of five cards from a standard deck of fifty-two playing cards; d. each of one or more players, placing a war bet and a poker bonus bet with the banker to play in a base round; e. a dealer, dealing a base hand of three cards face up to each player and to the dealer; f. the dealer, evaluating the rank of each player's base hand and the dealer's base hand based on the three-card hand ranking; g. selecting the base round players whose base hand ranks lower than the dealer's base hand as losing base round players; h. selecting the base round players whose base hand ranks the same as the dealer's base hand as tying base round players; selecting the base round players whose base hand ranks higher than the dealer's base hand as winning base round players; selecting the base round players whose base hand matches a hand to which a poker bonus pay-out ratio has been assigned as winning poker bonus players; k. each losing base round player, forfeiting that player's war bet to the banker; l. the banker, paying each winning poker bonus player the amount of that player's poker bonus bet times the poker bonus pay-out ratio corresponding to that player's base hand; m. the banker paying each winning base round player an amount that is greater than that player's War bet but less than ten times that player's war bet; n. each of one or more tying base round players, placing a bonus war bet with the banker equal to that player's War bet to play in a bonus round; o. the banker, paying each of the tying base round players not playing in the bonus round an amount equal to no more than that player's war bet; p. the dealer, dealing two bonus cards face up to each player playing in the bonus round and to the dealer; q. each bonus round player, combining that player's bonus cards with that player's base hand to form a player's bonus hand; r. the dealer, combining the dealer's bonus cards with the dealer's base hand to form a dealer's bonus hand; s. the dealer, evaluating the rank of each player's bonus hand and the dealer's bonus hand based on the five-card hand ranking; t. selecting the bonus round players whose bonus hand ranks lower than the dealer's bonus hand as losing bonus round players; u. selecting the bonus round players whose bonus hand ranks the same as the dealer's bonus hand as tying bonus round players; v. selecting the bonus round players whose bonus hand ranks higher than the dealer's bonus hand as winning bonus round players; w. each losing bonus player, forfeiting that player's war bet and bonus war bet to the banker; x. the banker, paying each winning bonus round player an amount that is at least ten times but less than one-hundred times that player's bonus war bet; y. each of one or more tying bonus round players, placing a super bonus war bet with the banker equal to that player's war bet to play in a super bonus round; z. the banker, paying each tying bonus round player not playing in the super bonus round an amount that is no more than five times that player's bonus war bet; aa. the dealer, dealing one super bonus card face up to each player playing in the super bonus round and to the dealer; bb. each super bonus round player, selecting five cards from the combination of that player's bonus hand and super bonus card to form that player's super bonus hand; cc. the dealer, selecting five cards from the combination of the dealer's bonus hand and super bonus card to form the dealer's super bonus hand; dd. the dealer, evaluating the rank of each player's super bonus hand and the dealer's super bonus hand based on the five-card hand ranking; ee. selecting the super bonus round players whose super bonus hand ranks lower than the dealer's super bonus hand as losing super bonus round players; ft. selecting the super bonus round players whose super bonus hand ranks the same as the dealer's super bonus hand as tying super bonus round players; gg. selecting the super bonus round players whose super bonus hand ranks higher than the dealer's super bonus hand as winning super bonus round players; hh. each losing super bonus round player, forfeiting that player's war bet, bonus war bet and super bonus war bet to the banker; ii. the banker, paying each winning super bonus round player an amount that is at least one-hundred times but no more than one-thousand times that player's super bonus war bet; and, jj. the banker, paying each tying super bonus round player an amount that is at least ten-thousand times but less than twenty-thousand times that player's super bonus war bet.

11. The method of claim 10 where the three-card hand ranking is like three-card poker hand ranking.

12. The method of claim 10 where the five-card hand ranking is like five-card poker hand ranking.

13. The method of claim 10 where the three-card hand ranking is like three-card poker hand ranking, and the five-card hand ranking is like five-card poker hand ranking.

14. A method of playing a card game with bonus wagering, comprising the steps of: causing an electronic machine to execute a plurality of instructions to operate with an input device and display device to provide said card game with bonus wagering, said card with bonus wagering comprising the steps of: a. a banker, establishing a three-card hand ranking by assigning a rank to each unique combination of three cards from a standard deck of fifty-two playing cards; b. the banker, assigning a poker bonus pay-out ratio to one or more of the unique three card combinations in the three-card hand ranking; c. the banker establishing a five-card hand ranking by assigning a rank to each unique combination of five cards from a standard deck of fifty-two playing cards; d. each of one or more players, placing a war bet and a poker bonus bet with the banker to play in a base round; e. each of two or more of the players, placing a community war bet with the banker to play community war; f. a dealer, dealing a base hand of three cards face up to each player and to the dealer; g. the dealer, evaluating the rank of each player's base hand and the dealer's base hand based on the three-card hand ranking; h. selecting the base round players whose base hand ranks lower than the dealer's base hand as losing base round players; selecting the base round players whose base hand ranks the same as the dealer's base hand as tying base round players; selecting the base round players whose base hand ranks higher than the dealer's base hand as winning base round players; k. selecting the base round players whose base round hand matches a hand to which a poker bonus pay-out ratio has been assigned as winning poker bonus players; l. selecting the community war player whose base hand ranks highest among the base hands of all community war players as a winning community war player; m. each losing base round player, forfeiting that player's war bet to the banker; n. the banker, paying each winning poker bonus player the amount of that player's poker bonus bet times the poker bonus pay-out ratio corresponding to that player's base hand; o. the banker, paying each winning base round player an amount that is greater than that player's war bet but less than ten times that player's war bet; p. the banker, paying the winning community war player from the accumulated community war bets; q. each of one or more of the tying base round players, placing a bonus war bet with the banker equal to that player's war bet to play in a bonus round; r. the banker, paying each tying base round player not playing in the bonus round an amount equal to no more than that player's war bet; s. the dealer, dealing two bonus cards face up to each player playing in the bonus round and to the dealer; t. each bonus round player, combining that player's bonus cards with that player's base hand to form a player's bonus hand; u. the dealer, combining the dealer's bonus cards with the dealer's base hand to form a dealer's bonus hand; v. the dealer, evaluating the rank of each player's bonus hand and the dealer's bonus hand based on the five-card hand ranking; w. selecting the bonus round players whose bonus hand ranks lower than the dealer's bonus hand as losing bonus round players; x. selecting the bonus round players whose bonus hand ranks the same as the dealer's bonus hand as tying bonus round players; y. selecting the bonus round players whose bonus hand ranks higher than the dealer's bonus hand as winning bonus round players; z. each losing bonus round player, forfeiting that player's war bet and bonus war bet to the banker; aa. the banker, paying each winning bonus round player an amount that is at least ten times but less than one-hundred times that player's bonus war bet; bb. each of one or more of the tying bonus round players, placing a super bonus war bet with the banker equal to that player's war bet to play in a super bonus round; cc. the banker, paying each tying bonus round player not playing in the super bonus round an amount that is no more than five times that player's bonus war bet; dd. the dealer, dealing one super bonus card face up to each player playing in the super bonus round and to the dealer; ee. each super bound round player, selecting five cards from the combination of that player's bonus hand and super bonus card to form that player's super bonus hand; ft. the dealer, selecting five cards from the combination of the dealer's bonus hand and super bonus card to form the dealer's super bonus hand; gg. the dealer, evaluating the rank of each player's super bonus hand and the dealer's super bonus hand based on the five-card hand ranking; hh. selecting the super bonus round players whose super bonus hand ranks lower than the dealer's super bonus hand as losing super bonus round players; ii. selecting the super bonus round players whose super bonus hand ranks the same as the dealer's super bonus hand as tying super bonus round players; jj. selecting the super bonus round players whose super bonus hand ranks higher than the dealer's super bonus hand as winning super bonus round players; kk. each losing super bonus round player, forfeiting that player's war bet, bonus war bet and super bonus war bet to the banker; ll. the banker, paying each winning super bonus round player an amount that is at least one-hundred times but no more than one-thousand times that player's super bonus war bet; and, mm. the banker, paying each tying super bonus round player an amount that is at least ten-thousand times but no more than twenty-thousand times that player's super bonus war bet.

15. The method of claim 14 where the three-card hand ranking is like three-card poker hand ranking.

16. The method of claim 14 where the five-card hand ranking is like five-card poker hand ranking.

17. The method of claim 14 where the three-card hand ranking is like three-card poker hand ranking, and the five-card hand ranking is like five-card poker hand ranking.

18. The method of claim 14 where the banker, paying the winning community war player all of the accumulated community war bets.

* * * * *